US007309247B1

(12) United States Patent
Keating

(10) Patent No.: US 7,309,247 B1
(45) Date of Patent: Dec. 18, 2007

(54) CABLE INTERCONNECT

(75) Inventor: Michael J. Keating, Jackson, PA (US)

(73) Assignee: Micro-Coax, Pottstown, PA (US)

( * ) Notice: Subject to any disclaimer, the term of this patent is extended or adjusted under 35 U.S.C. 154(b) by 0 days.

(21) Appl. No.: 11/438,987

(22) Filed: May 23, 2006

(51) Int. Cl.
*H01R 13/52* (2006.01)

(52) U.S. Cl. ..... 439/271

(58) Field of Classification Search ..... 439/271, 439/578, 675, 609
See application file for complete search history.

(56) References Cited

U.S. PATENT DOCUMENTS 4,545,633 A * 10/1985 McGeary ..... 439/141
4,925,403 A 5/1990 Zorzy ..... 439/578
5,435,745 A * 7/1995 Booth ..... 439/584
6,217,384 B1 * 4/2001 Strasser et al. ..... 439/583
6,224,421 B1 * 5/2001 Maturo, Jr. ..... 439/581
6,827,608 B2 12/2004 Hall et al. ..... 439/578
6,910,910 B2 * 6/2005 Cairns ..... 439/352

* cited by examiner

*Primary Examiner*—Phuong KT Dinh
(74) *Attorney, Agent, or Firm*—Drinker Biddle & Reath LLP

(57) ABSTRACT

A connection device comprises first and second connectors. The first connector has a sleeve having axially extending slots at a distal end to define tines yieldable resiliently inward, and a resilient seal encircling the sleeve proximally of the slots. The second connector has a shroud dimensioned to receive the distal end of the first connector sleeve within the shroud and to engage the first connector resilient seal when the sleeve is fully received within the shroud.

15 Claims, 6 Drawing Sheets

CABLE INTERCONNECT

BACKGROUND

The invention relates to connectors, and especially to a connector for coaxial cables.

U.S. Pat. No. 4,925,403 to Zorzy and U.S. Pat. No. 6,827,608 to Hall et al., which are incorporated herein by reference in their entirety, show connection devices for coaxial cables. In each of those devices, one connector has a center pin, formed as an extension of the center conductor of a coaxial cable, surrounded by a tubular metal shroud. The mating connector has a center socket surrounded by a dielectric component, which is surrounded by a metal sleeve with a clearance between the dielectric component and the sleeve. The sleeve is slotted at its distal end to form a ring of tines or beams joined together by an unslotted base part of the sleeve. The tines are resilient, and when the sleeve is inserted into the shroud, thickened tips on the tines snap into a groove or trepan formed inside the shroud. The connected sleeve and shroud form the electrical connection for the shroud of the coaxial cable.

With this form of connection device as generally used, proximal or base ends of the slots in the sleeve are exposed through a gap between the sleeve and the distal end of the shroud. As a result, water and other contaminants can enter the connection, and can penetrate the space between the sleeve and the center conductor. Contaminant penetration can cause corrosion of the connection device, loss of electrical continuity either directly from contaminant penetration or from the formation of corrosion products, and changes to the electrical impedance of the connection that may interfere with the transmission of signals along the coaxial cable. In addition, the lack of physical continuity of the conductive shroud due to the slots, especially if the two halves of the connection device are not precisely coaxial so that the slots form an asymmetrical pattern, can allow unacceptable levels of signals to radiate to the external environment. The radiating signal may cause interference with neighboring devices, and the loss of signal energy may impair signal transmission along the coaxial cable.

SUMMARY

According to one embodiment of the invention, there is provided a connector, comprising a sleeve having axially extending slots at a distal end to define tines yieldable resiliently inward, and a resilient seal encircling the sleeve proximally of the slots.

According to another embodiment of the invention, there is provided a connector, comprising a sleeve having axially extending slots at a distal end to define tines yieldable resiliently inward, wherein the tines are stepped along their length.

According to another embodiment of the invention, there is provided a connection device, comprising a first connector having a sleeve with axially extending slots at a distal end to define tines yieldable resiliently inward and a resilient seal encircling the sleeve proximally of the slots and a second connector having a shroud dimensioned to receive the distal end of the first connector sleeve within the shroud and to engage the first connector resilient seal when the sleeve is fully received within the shroud.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to various embodiments of the present invention, examples of which are illustrated in the accompanying drawings.

Figures 1, 2:
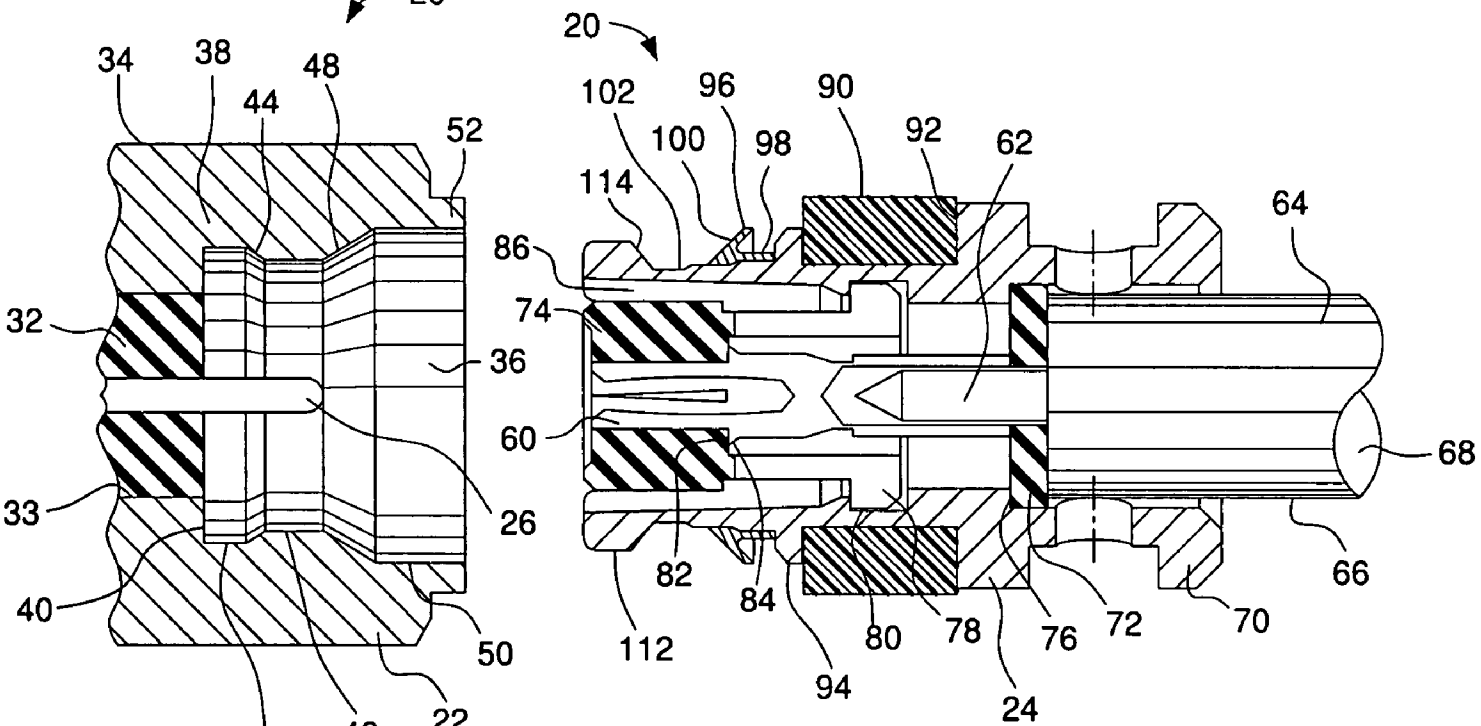
FIG. 1 is an axial section through a pin coaxial connector according to an embodiment of the invention.
FIG. 2 is an axial section through a socket coaxial connector according to an embodiment of the invention.

Referring to the drawings, and initially to FIGS. 1 and 2, one form of connection device according to an embodiment of the invention, indicated generally by the reference numeral 20, comprises a pin coaxial connector 22 (shown in FIG. 1) and a socket coaxial connector 24 (shown in FIG. 2).

Referring to FIG. 1, the pin coaxial connector 22 may be a panel mount connector arranged to be mounted on or through the wall of an electronics module (not shown). The pin coaxial connector 22 comprises a central pin 26, which is mounted in a dielectric 32 that is received in a bore 33 of a metal shroud 34 coaxial with the central pin 26. The shroud 34 may be electrically bonded to the wall of the electronics module, or may be carried through the wall in an insulating bushing (not shown). The fittings for attaching the connector 22 to the electronics module may be conventional and, in the interests of simplicity, are not shown in FIG. 1. Various methods of attaching the connector 22 to the electronics module are known, and in the interests of conciseness will not be further described here.

The inside of the shroud 34 has a cavity 36 into which the central pin 26 projects. The cavity 36 terminates at a reference plane 38 defined partly by the cut end of the dielectric 32, and partly by a flat, radially extending wall 40 of the shroud 34, extending outward from the bore 33.

The cavity 36 is rotationally symmetrical about the axis defined by the central pin 26. From the reference plane 38 toward the distal end of the connector 22, the cavity 36 is defined by a trepan 42, a ramp 44 sloping inward from the trepan, a neck 46 smaller than the trepan 42 and slightly larger in diameter than the bore 33, a lead-in taper 48 that widens from the neck 46 towards the distal end, and a cylindrical stabilizer section 50. The distal end of the shroud 34 is formed by a seal lip 52 defining the outermost part of the stabilizer section 50.

Referring now to FIG. 2, the socket coaxial connector 24 has a center contact 60 that is dimensioned to be a push fit at a distal end on the central pin 26 of the pin coaxial connector 22 shown in FIG. 1. The other, proximal end of the center contact 60 is a push fit on a central pin 62 that is a continuation of a center conductor of a coaxial cable 64. An outer conductor 66 and dielectric 68 of the coaxial cable 64 may be cut back, leaving the end of the center conductor exposed to form the central pin 62. Alternatively, a separate pin 62 may be electrically bonded to the center conductor of the coaxial cable 64.

A metal sleeve 70 has a proximal end that fits over and is electrically bonded to the outer conductor 66 of the coaxial cable 64, and a distal end that projects slightly beyond the distal end of the center contact 60. The space between the center contact 60 and the sleeve 70 is occupied by dielectric components 72, 74 that serve both to maintain the alignment and spacing between the center contact 60 and the sleeve 70 and to maintain the correct transmission line impedance to match the coaxial cable 64. As shown in FIG. 2, one dielectric component 72 is a washer trapped between the end of the coaxial cable 64 and a shoulder 76 on the inside of the sleeve 70. Another dielectric component 74 is retained by hooks 78 that catch in a groove 80 on the inside of the sleeve 70, and has a shoulder 82 that engages a shoulder 84 on the center contact 60 to keep the center contact 60 in position in the connector 24. For a reason that will be explained below, there is a clearance 86 between the dielectric component 74 and the inside of the sleeve 70 at the distal end of the sleeve 70. Alternatively, other configurations and arrangements of the dielectric components are possible, including many suitable configurations and arrangements that are known to the person skilled in the art.

The sleeve 70 is encircled by a soft elastomeric gasket 90 that is retained in place between a shoulder 92 at the proximal end of the gasket 90 and a stabilizer shoulder 94 at the distal end of the gasket. The shoulder 92 extends approximately the full radial height of the gasket 90. The shoulder 94 extends only part of the height of the gasket. The length from the distal end of the gasket 90 to the distal end of the sleeve 70 is slightly less than the length from the tip of the seal lip 52 to the reference plane 38 of the pin coaxial connector 22 shown in FIG. 1. The radially outer face of the stabilizer shoulder 94 has a radius just less than the radius of the stabilizer section 50. On the distal side of the stabilizer shoulder 94, the sleeve 70 is encircled by a metal EMI shield ring 96. The EMI shield ring 96 has a cylindrical base 98 that fits snugly around the sleeve 70, and a flange 100 that is attached to the distal end of the base and slopes outwards and back towards the proximal end. The EMI shield ring 96 may be divided by a single narrow slit (not shown) to allow the EMI shield ring to expand and contract in the circumferential direction.

Figure 4:
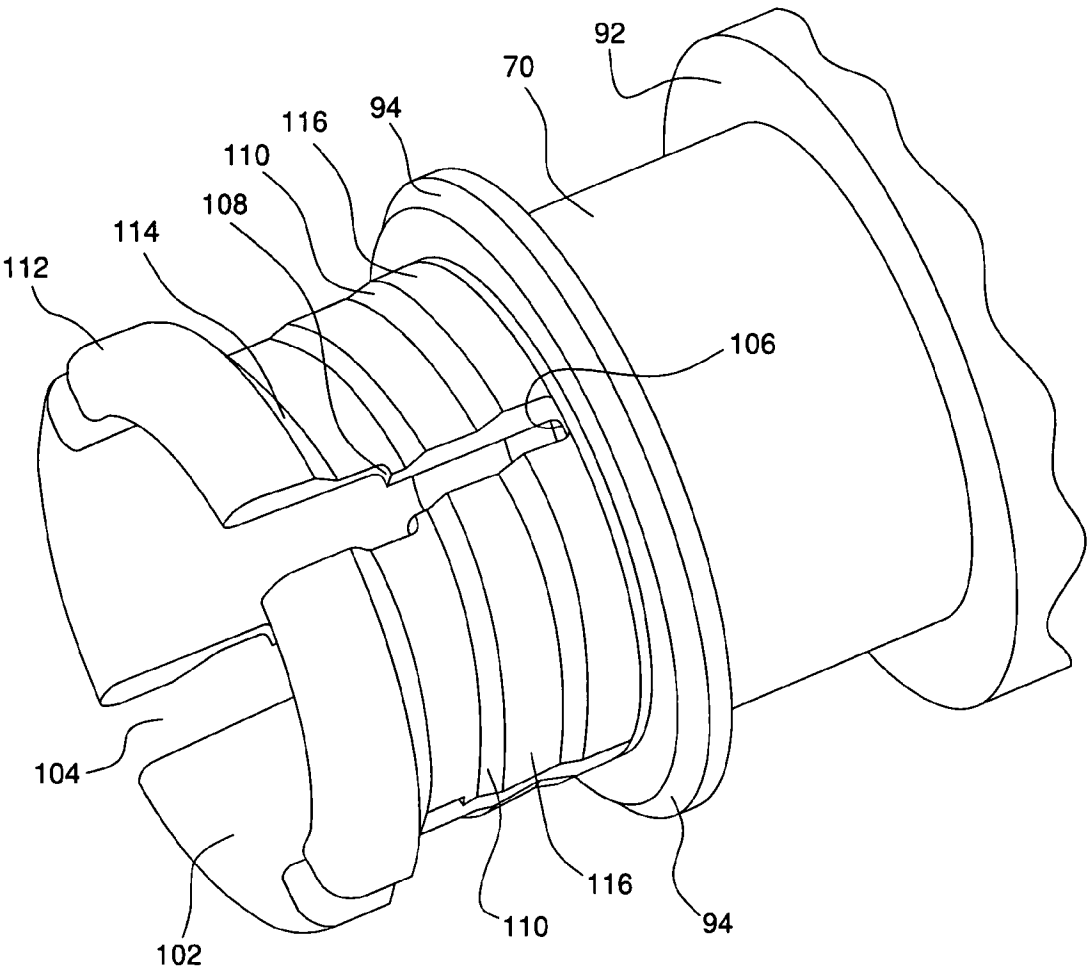
FIG. 4 is a perspective view of part of the socket coaxial connector shown in FIG. 2.

The distal end of the sleeve 70 is divided into tines 102 by slots 104, best seen in FIG. 4. The slots 104 open through the distal end of the sleeve 70, and have closed roots 106 just short of the stabilizer shoulder 94. As may be seen in FIG. 4, the width of the slots 104 increases from the roots 106 to the open ends of the slots 104. In the embodiment shown in FIG. 4, each slot 104 has two sections of approximately equal length, each section having straight, parallel walls, separated by a step 108. The step 108 is not tapered, but the concave angles between the step 108 and the wider part of the slot 104 may be rounded to a radius that is a substantial part of the width of the step 108. It has been found that a configuration with four slots 104 is easy to manufacture and can give close to optimal performance for at least some connector configurations. However, other numbers of slots may be used in appropriate configurations of the connector 24. Slots with more than one step 108 may be used in appropriate configurations of the connector 24.

The thickness of the tines 102 decreases in steps 110 from the roots 106 of the slots 104 to the distal end of the sleeve 70. The tips 112 of the tines 102 are formed as outward thickenings of the tines 102, with ramps 114 on the proximal faces. In the embodiment shown in FIG. 4, the length of the tines 102 between the stabilizer shoulder 94 and the beginnings of the ramps 114 is divided into three approximately equal straight sections 116 by two steps 110. The straight sections 116 are cylindrical, and the steps 110 are gently sloped. Because of the length of the tips 112 of the tines 102, the step 108 in the width of the slot 104 is in the most distal of the straight sections 116, just distal of the more distal step 110.

The steps 108, 110 increase the effective flexibility of the tines 102, by concentrating bending stresses at the steps, and thus allow shorter tines 102 for the same radial yield characteristics of the tips of the tines than would be possible with straight or smoothly tapering tines of the same thickness and strength. The steps 108, 110 thus allow a correspondingly shorter connector 24.

When the socket coaxial connector 24 is inserted into the pin coaxial connector 22, the tips 112 of the tines 102 fit inside the stabilizer section 50 with a clearance. The tine tips 112 then contact the lead-in taper 48. The taper angle of the lead-in taper 48 is sufficiently gentle that an axial force urging the connectors 22, 24 together will result in the lead-in taper 48 deflecting the tines 102, permitting further insertion of the socket center connector 24 into the pin center connector 22. The clearance 86 between the tines 102 and the dielectric component 74 permits the tines 102 to deflect.

As the socket connector 24 is inserted, the EMI shield ring 96 enters the stabilizer section 50. The stage of the insertion at which this and other events occur, and the order in which they occur, may vary depending on the exact design of the connectors 22, 24. The EMI shield ring 96 may be dimensioned so that when the connectors 22, 24 are exactly coaxial the outer edge of the EMI shield ring 96 does not quite touch the internal surface of the stabilizer section 50. The EMI shield ring 96 is positioned axially so as to rest against the lead-in taper 48 when the connectors 22, 24 are fully engaged. Alternatively, the EMI shield ring 96 may be dimensioned so that its outer edge is deflected slightly by the tapered lead-in section of the stabilizer section 50, and then slides along the internal surface of the stabilizer section 50. The EMI shield ring 96 may then be positioned axially so as to rest either against the lead-in taper 48 or against the internal surface of the stabilizer section 50 when the connectors 22, 24 are fully engaged. The shroud 34, EMI shield ring 96, and sleeve 70 thus provide a continuous electrical path without gaps, or with only a single small gap because of the slit in the EMI shield ring, between the outer conductor 66 of the coaxial cable 64 and the shroud 34. If the connectors 22 and 24 are not exactly coaxial, contact between the seal lip 52 and the sloped front surface of the EMI shield ring 96 will guide the connectors into alignment.

As the socket center connector 24 is inserted, the center contact 60 of the socket center connector starts to slide onto the central pin 26 of the pin center connector 22.

When the distal ends of the tine tips 112 reach the inner, narrow end of the lead-in taper 48, the tine tips 112 move onto the cylindrical surface of the neck 46. The diameter of the neck 46, compared with the undeflected diameter of the tine tips 112, determines the minimum sizes of the width of the slots 104, and of the radial clearance 86 between the dielectric component 74 and the tines 102, to permit the necessary radial deflection of the tines 102.

The seal lip 52 of the pin center connector 22 continues past the EMI shield ring 96 and over the socket stabilizer shoulder 94. The socket stabilizer shoulder 94 permits the stabilizer section 50 to slide over it without binding but with minimum play. The socket stabilizer shoulder 94 and the stabilizer section 50 can thus cooperate to ensure that the connectors 22, 24 remain correctly aligned. The facing edges of the socket stabilizer shoulder 94 and/or the seal lip 52 are chamfered or rounded, so that they will deflect each other into alignment, achieving trouble-free insertion of the socket stabilizer shoulder 94 into the stabilizer section 50, rather than catching on each other if the two connectors are not already exactly aligned. Because the two connectors are already approximately aligned by the EMI shield ring 96, only a slight chamfer or rounding is typically required. After crossing the socket stabilizer shoulder 94, the seal lip 52 presses into the gasket 90, which deforms slightly and forms a fluid-tight seal between the shrouds 34 and 70, and thus between the coaxial cables 64 and the electronics module.

Figure 3:
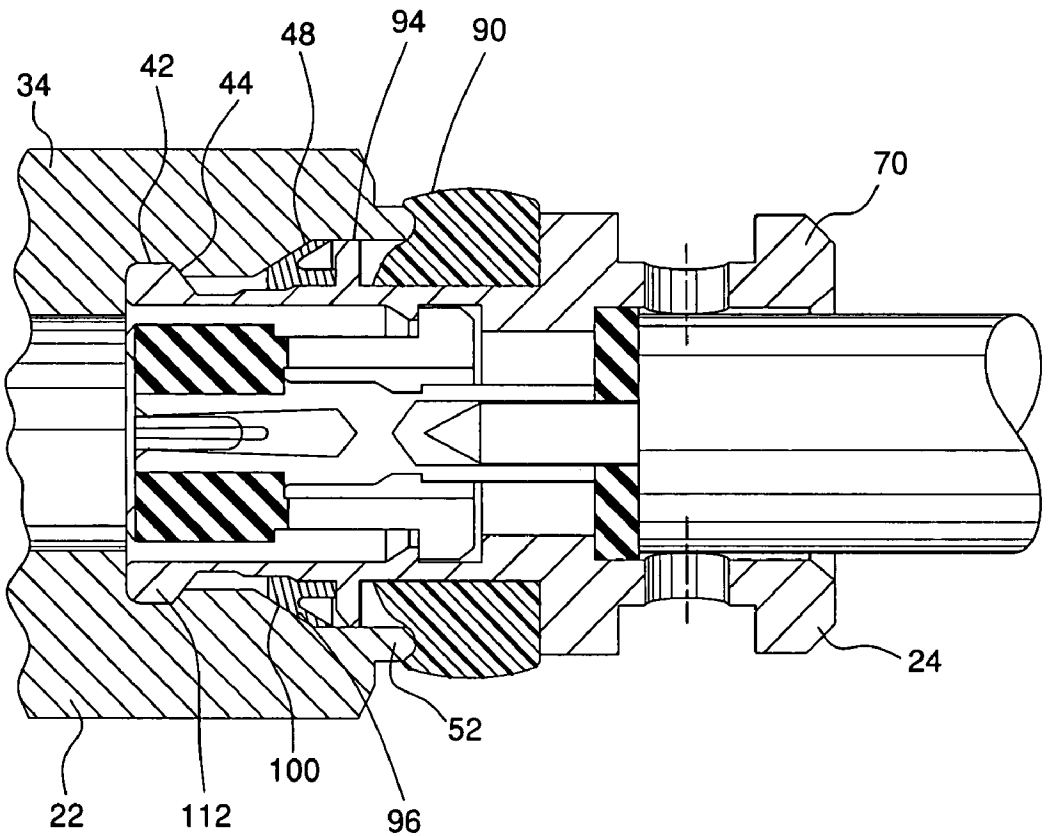
FIG. 3 is an axial section through a connection device comprising a pin coaxial connector according to FIG. 1 and a socket coaxial connector according to FIG. 2 connected together.

As the tine tips 112 pass the neck 46, the tine tips expand into the shroud retention trepan 42. In the fully engaged position, as shown in FIG. 3, the tine tips 112 are urged outwards into the retention trepan 42 by the resilience of the tines 102. The ramps 114 on the rear edges of the tine tips 112, resting on the ramp 44, then produce a wedging action that urges the distal end of the socket coaxial connector 24 into contact with the reference plane 38 of the pin coaxial connector 22. The wedging action is sufficiently strong to overcome the restoring force from the compression of the gasket 90 by the seal lip 52.

When the connectors 22 and 24 are to be separated, the tines 102 are inaccessible within the shroud 34, and cannot be directly compressed radially. However, an axial force can be applied by pulling the connectors 22, 24 apart. The ramp 44 then acts to deflect the tine tips 112 inwards as they are withdrawn axially. Therefore, the angle at which the ramps 114 on the tine tips 112 rides on the ramp 44 is chosen to be sufficiently close to 45°, and the surface finish of the ramps 44 and 114 is chosen to have a sufficiently low coefficient of friction, that the ramps 44 and 114 can both generate an axial force from a radial force and generate a radial force from an axial force. In a practical embodiment, the cone half-angle of the ramp 44 is around 30° and the cone half-angle of the slope 114 on the tine tips 112 is around 40°, so that the angle at the outer edge of the ramps 114 slides on the ramps 44. Alternatively, depending on the relative angles of the ramps 44 and 114, the ramps 114 of the tine tips 112 may lie flat on the ramp 44 of the shroud 34, or the angle between the ramp 44 and the neck 46 may bear on the ramps 114. The material of the gasket 90 is sufficiently soft compared with the stiffness of the tines 102 that the resilience of the gasket does not overcome the resilience of the tines and cause undesired separation of the connectors 22, 24 in use.

The EMI shield ring 96 may be trapped between the socket stabilizer shoulder 94 and the lead-in taper 48 with substantially no play, or with the flange 100 of the EMI shield ring pressed against the lead-in taper. If the EMI shield ring 96 is compressed against the lead-in taper 48 so as to exert a significant axial restoring force, that restoring force contributes to the balance of forces on the tine tips 112, and the tines 102 are made sufficiently stiff that the combined axial force from the EMI shield ring 96 and the gasket 90 does not overcome the resilience of the tines 102 and cause undesired separation of the connectors 22, 24 in use.

When the connectors 22 and 24 are separated, an axial force is exerted sufficient that the ramp 44 deflects the tine tips 112 inward to pass through the neck 46, and to pull the central pin 26 out of the center contact 60. Another dielectric component 74 is retained by, and has a to keep the center contact 60 in position in the connector 24. The dielectric component 74 acts as a retaining clip for the center contact 60, with the shoulder 82 on the dielectric component 74 engaging the shoulder 84 on the center contact 60 and the hooks 78 on the dielectric component 74 catching in the groove 80 on the inside of the sleeve 70. The center contact 60 thus remains in the socket coaxial connector 24 and is not pulled out with the central pin 26. The outer lip of the flange 100 of the EMI shield ring 96 may be shaped, for example, rounded, so that the EMI shield ring does not bind on the stabilizer section 50.

The connection device shown in FIG. 3 joins a pin coaxial panel mount connector to a socket coaxial connector on a coaxial cable. Alternatively, the connection device may be applied to other configurations, including a device where two coaxial cables, both having pin coaxial connectors, are joined by an adaptor having two socket coaxial connectors, or vice versa, or a connection device where two coaxial cables are connected using a pin coaxial connector on one cable and a socket coaxial connector on the other cable, or a device with a socket coaxial panel mount connector, or with either or both connectors mounted or attached in some other way.

Figure 5:
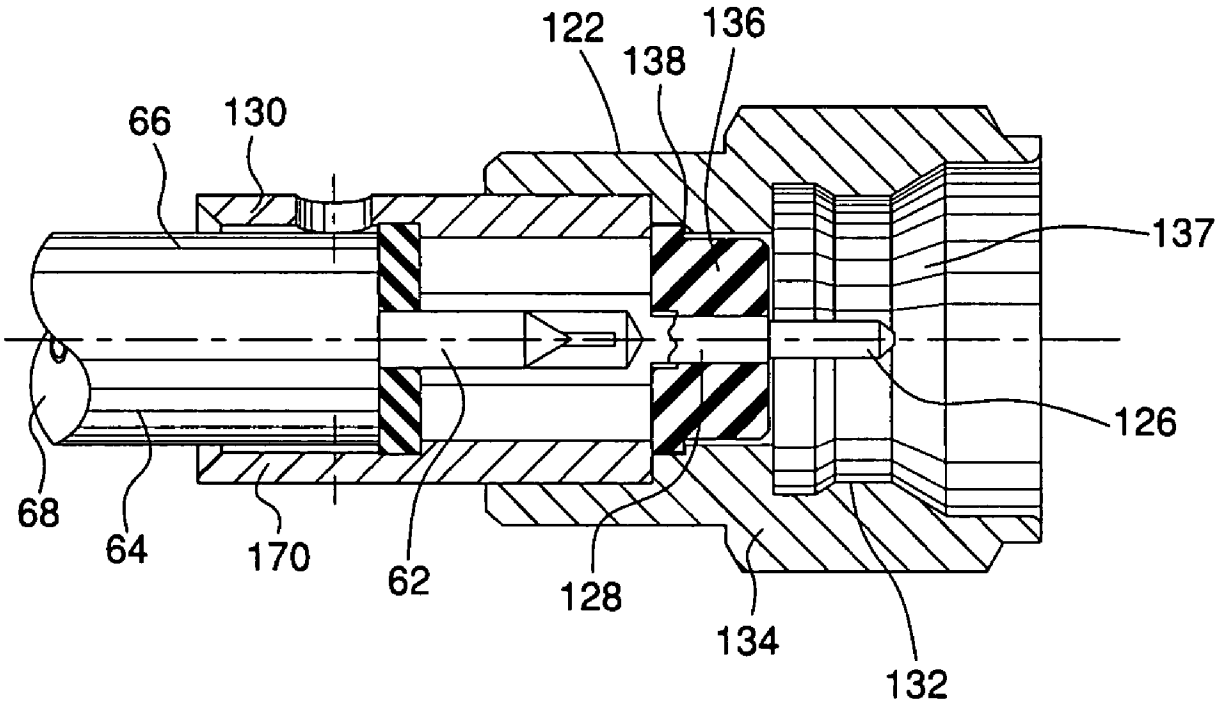
FIG. 5 is a view similar to FIG. 1 of an alternative form of pin coaxial connector.

Referring to FIG. 5, in an alternative form of pin coaxial connector 122 according to an embodiment of the invention mounted on a coaxial cable, the central pin 126 of the pin coaxial connector is formed by a contact 128 that is a push fit on a central pin 62 formed by the center conductor of the coaxial cable 64, similarly to the center contact 60 shown in FIG. 2. The outer conductor 66 of the coaxial cable 64 is received in, and electrically bonded to, a metal sleeve 130. The front end of the sleeve 130 is received in, and electrically bonded to, a stepped bore 132 in the rear end of a metal shroud 134 coaxial with the central pin 126. An insulator 136 is trapped between the sleeve 130 and a step 138 in the bore 132, and the contact 128 is retained behind the insulator 136. The insulator 136 occupies the narrowest portion of the bore 132. Forward of the insulator 136, the bore 132 opens out into a cavity 137, the shroud 134 and the cavity 137 having the same configuration as the shroud 34 and cavity 36 shown in FIG. 1. The pin coaxial connector 122 shown in FIG. 5 can connect to the socket coaxial connector 24 shown in FIG. 2 in the same way as the pin coaxial connector 22.

Various materials may be used for the connectors 22, 24, 122. However, for the sleeve 70 of a connector 24 comparable to the Series SMP interface specified in United States specifications DSCC 94007 and DSCC 94008, and having the shape shown in FIG. 4, Beryllium-copper alloy according to ASTM-B-196, Uns No. C17300, Temper TD04(H), heat treated after machining to Temper TH04(T), finish gold over nickel plate, may be preferred. This material is found to have a high level of fatigue resistance that is desirable for the tines 102 especially in applications involving a large number of connections and disconnections. If the material of the tines 102 softens or deforms permanently, the force required for disconnection may become low, and the connectors and may become disengaged inadvertently. If the material of the tines 102 work-hardens, the force required for connection and disconnection may become undesirably high. For a connector of the size of the Series SMP interface, with a diameter of around 0.130" (3.3 mm) across the tine tips 112 in the unstressed state, the shape of the tines 102 shown in FIG. 4 is found to be satisfactory. However, for connectors of other sizes, or different performance requirements, other shapes, for example, different numbers or positions of the steps 108, 110, different widths and thicknesses for the slots 104 and the sections 116, and different angles for the various tapered surfaces 110, 114, etc. may be preferred.

Figure 6:
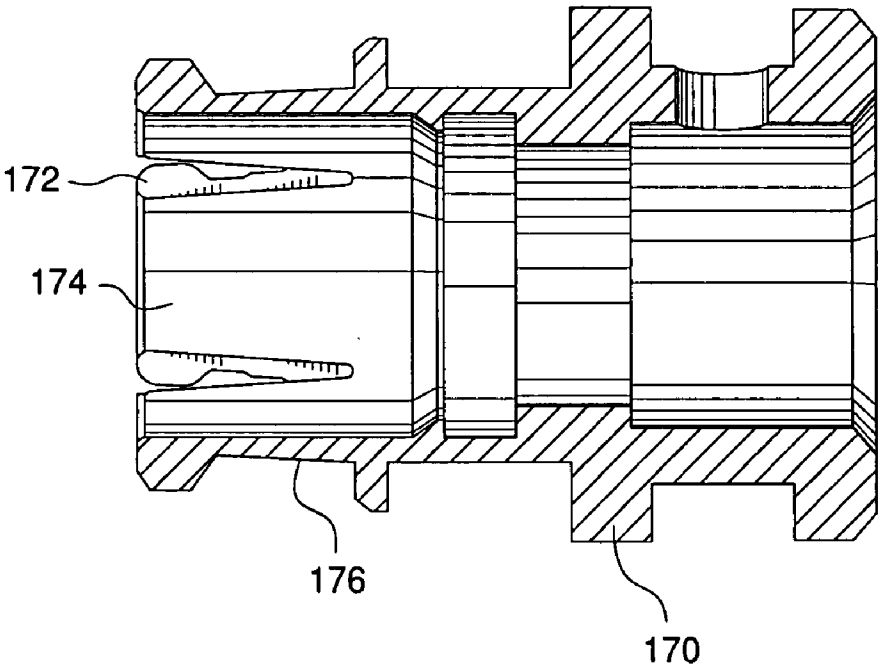
FIG. 6 is an axial section through part of an alternative form of socket coaxial connector.

Referring to FIG. 6, an alternative form of sleeve 170 for use in a connector according to an embodiment of the invention is generally similar to the sleeve 70 shown in FIGS. 2 to 4, except that the sleeve 170 has five slots 172 defining five tines 174, and the slots 172 are evenly tapered, forming a V-shape with a rounded root 176. The tines are tempered to spring temper after splaying. The configuration of sleeve 170 shown in FIG. 6 is suitable for a connector of the size of a Series WSMP interface, with a diameter of around 0.125" (3.125 mm) across the tine tips 178 in the unspread state and around 0.130" (3.3 mm) in the spread and tempered state.

Stepped slots such as the slots 104 shown in FIG. 4 may be formed by sawing parallel-sided slots in the sleeve 70. V-shaped slots such as the slots 172 shown in FIG. 6 may be formed by cutting the slots in a V shape. In each case, the tines 102, 174 may then be splayed out so as to increase the effective diameter at the tip by several percent. The minimum diameter to which the tines can be compressed to pass through the neck 46 is set by the diameter before spreading and the amount of material cut away in forming the slots. For example, for a Series SMP or Series WSMP interface, the neck 46 has an internal diameter of 0.116"±0.002" (2.95 mm±0.05 mm), so the minimum diameter of the compressed tines 102, 174 may be no greater than 0.114" (2.90 mm).

The greater number of slots 172 makes the tines 174 more flexible, because each tine spans a smaller arc of a circle and is thus less stiffened by its transverse curvature. The smoothly tapered slots 172 make the tines 174 less flexible, by eliminating the concentration of stress, and thus of flexing, at the shoulder 108. However, by eliminating the concentration of stress, the tines 174 with smoothly tapered slots 172 may be less subject to fatigue, and may have a longer working life. In addition, the tapered slots 104, 172 can reduce RF leakage, because even if the EMI shield ring 96 does not completely prevent RF leakage, only the narrow roots of the slots are exposed outside the shroud 34, 134.

Figure 7:
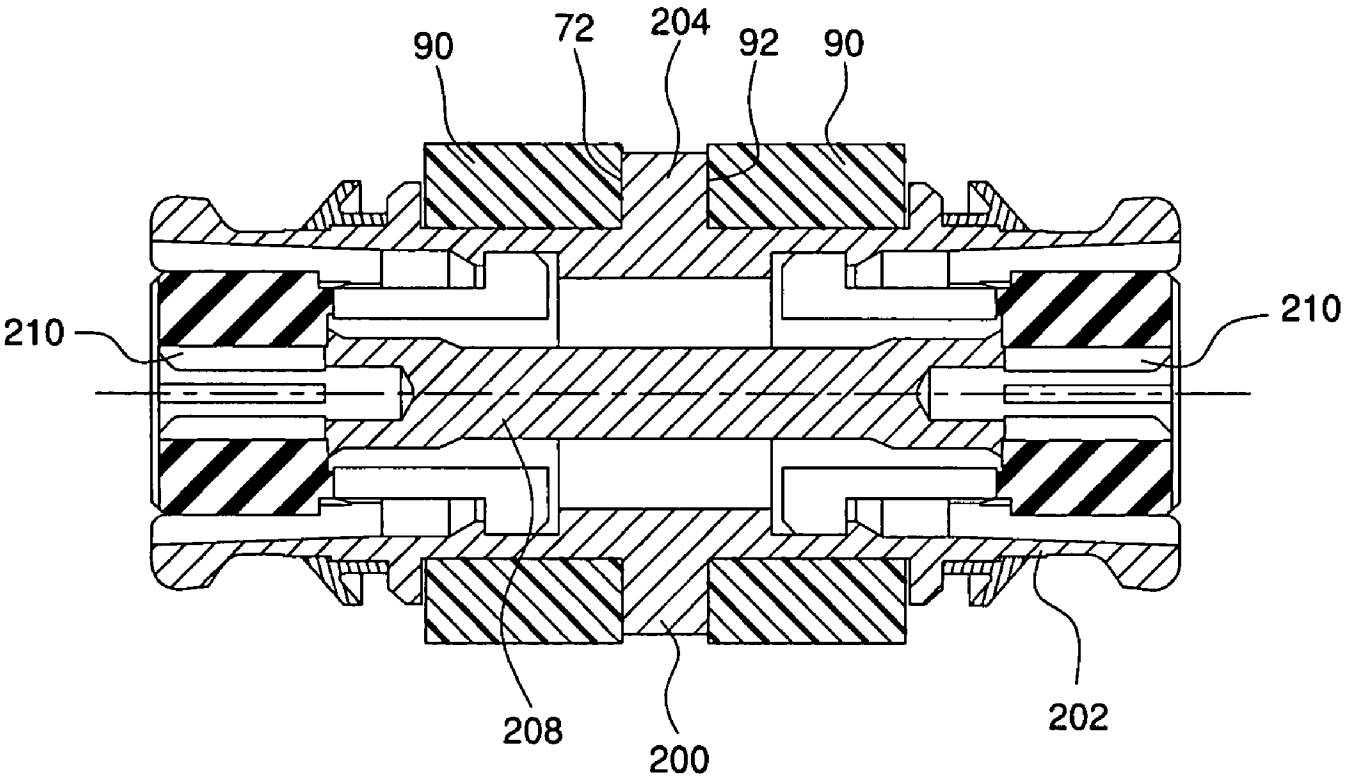
FIG. 7 is an axial section through a socket coaxial to socket coaxial bullet connector.

Referring to FIG. 7, a socket coaxial to socket coaxial bullet connector 200 according to an embodiment of the invention has two ends each of which is generally similar to the connector 24 shown in FIG. 2 from its distal end to the flange that defines the shoulder 92 that supports the gasket 90. However, in the bullet connector 200, the sleeve 202 has a central flange 204 that defines shoulders 92 on both end faces, and has two distal ends beyond the two shoulders 92. Instead of each socket coaxial connector having a center contact 60, as shown in FIG. 2, that is then bonded to the exposed end 62 of the center wire of the coaxial cable 64, the bullet connector 200 has a center shaft 208 with a center contact 210 formed on each end. Other features of the bullet connector 200 can be understood by comparing FIG. 7 to FIG. 2 and referring to the text describing FIGS. 2 to 4 and, in the interests of conciseness, that description is not repeated here. It can also be understood from a comparison of FIGS. 5 and 7 how to construct a socket coaxial to pin coaxial or pin coaxial to pin coaxial bullet connector.

Various modifications and variations can be made in the present invention without departing from the spirit or scope of the invention. Thus, it is intended that the present invention cover modifications and variations of this invention provided they come within the scope of the appended claims and their equivalents.

For example, although the shroud 34, the sleeve 70, and the EMI shield ring 96 are described as being of metal, any or all of them may be made of any material, including materials to be developed hereafter, that provides the desired electrical conductivity and mechanical strength. Alternatively, any or all of the shroud 34, the sleeve 70, and the EMI shield ring 96 may be structures comprising electrically conductive and other components.

Although the invention has been described with reference to embodiments of coaxial electrical connectors, those skilled in the art will understand how features of different embodiments may be combined in a single device as may be appropriate for a specific purpose, and will understand that various aspects of the invention may be applied to other forms of connectors. For example, the combination of the shroud cavity 36 and the fingers 102, 174 may be used to provide a releasable mechanical connection in devices other than a coaxial electrical connector.

What is claimed is:

1. A connector comprising:

a sleeve having axially extending slots at a distal end to define tines yieldable resiliently inward, wherein the sleeve is electrically conductive;

a resilient face seal encircling the sleeve proximally of the slots;

a stabilizer shoulder projecting outward from the sleeve proximally of the slots and distally of the resilient seal, the stabilizer shoulder defining an outward-facing bearing surface substantially coaxial with the sleeve, and the seal projecting radially outward of the stabilizer shoulder; and an electrically conductive ring encircling the sleeve and arranged to form an electrical shield between the sleeve and another component encircling the sleeve.

2. A connector according to claim 1, wherein the tines are stepped along their length so as to decrease in size towards the distal end of the sleeve.

3. A connector according to claim 2, wherein the slots widen in steps towards the distal end of the sleeve.

4. A connector according to claim 2, wherein the thickness of the tines decreases in steps towards the distal end of the sleeve.

5. A connector according to claim 1, wherein the electrically conductive ring comprises a tubular component closely encircling the sleeve and a flange extending outward from the tubular component.

6. A connector according to claim 5, wherein the flange extends from the edge of the tubular component nearer the distal end of the sleeve, and the flange slopes outward away from the distal end of the sleeve.

7. A connector according to claim 1, wherein the sleeve is electrically conductive, further comprising an electrically conductive socket positioned coaxially within the sleeve and electrically insulated from the sleeve.

8. A connection device comprising:

a first connector having a sleeve with axially extending slots at a distal end to define tines yieldable resiliently inward and a resilient seal encircling the sleeve proximally of the slots; and a second connector having a shroud dimensioned to receive the distal end of the first connector sleeve within the shroud and to engage the first connector resilient seal so as to seal between the first and second connectors when the sleeve is fully received within the shroud;

wherein the first connector further comprises a stabilizer shoulder projecting outward from the sleeve proximally of the slots and distally of the resilient seal, the stabilizer shoulder defining an outward-facing bearing surface substantially coaxial with the sleeve and dimensioned to closely support the inside of the second connector shroud when the shroud is engaging the seal.

9. A connection device according to claim 8, wherein the tines are stepped along their length.

10. A connection device according to claim 9, wherein the slots widen in steps towards the distal end of the sleeve.

11. A connection device according to claim 9, wherein the thickness of the tines decreases in steps towards the distal end of the sleeve.

12. A connector according to claim 1, wherein the sleeve has a generally cylindrical outer surface proximally of the slots and distally of the resilient seal, from which surface the stabilizer shoulder projects outward.

13. A connection device comprising:

a first connector having a sleeve with axially extending slots at a distal end to define tines yieldable resiliently inward and a resilient seal encircling the sleeve proximally of the slots; and a second connector having a shroud dimensioned to receive the distal end of the first connector sleeve within the shroud and to engage the first connector resilient seal so as to seal the join between the first and second connectors when the sleeve is fully received within the shroud;

wherein the sleeve and the shroud are electrically conductive;

further comprising an electrically conductive ring encircling the sleeve and arranged to form an electrical shield between the sleeve and a part of the shroud encircling the sleeve when the sleeve is fully received within the shroud.

14. A connection device according to claim 13, wherein the electrically conductive ring comprises a tubular component closely encircling the sleeve and a flange extending outward from the tubular component.

15. A connection device according to claim 14, wherein the flange extends from the edge of the tubular component nearer the distal end of the sleeve, and the flange slopes outward away from the distal end of the sleeve.

* * * * *